US008864197B2

(12) United States Patent
Schneider et al.

(10) Patent No.: US 8,864,197 B2
(45) Date of Patent: Oct. 21, 2014

(54) DEVICE FOR FASTENING A SENSOR ASSEMBLY, ESPECIALLY A RADAR SENSOR

(75) Inventors: Klaus Schneider, Lindau (DE); Miroslav Knezevic, Friedrichshafen (DE); Martin Vallendor, Ravensburg (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days.

(21) Appl. No.: 13/816,293

(22) PCT Filed: Aug. 12, 2011

(86) PCT No.: PCT/DE2011/001592

§ 371 (c)(1), (2), (4) Date: Feb. 11, 2013

(87) PCT Pub. No.: WO2012/022301

PCT Pub. Date: Feb. 23, 2012

(65) Prior Publication Data

US 2013/0141269 A1 Jun. 6, 2013

(30) Foreign Application Priority Data

Aug. 12, 2010 (DE) ..... 10 2010 034 073

(51) Int. Cl.

| | |
|---|---|
| ***H01Q 1/32*** | (2006.01) |
| ***H01Q 15/02*** | (2006.01) |
| ***H01Q 19/06*** | (2006.01) |
| ***H01Q 3/26*** | (2006.01) |
| ***H01Q 19/10*** | (2006.01) |
| ***H01Q 1/42*** | (2006.01) |
| ***H01Q 1/12*** | (2006.01) |
| ***H01Q 17/00*** | (2006.01) |
| ***H01Q 21/00*** | (2006.01) |
| ***H01Q 15/14*** | (2006.01) |

(52) U.S. Cl.

CPC ..... *H01Q 1/12* (2013.01); *H01Q 15/02* (2013.01); *H01Q 19/062* (2013.01); *H01Q 3/26* (2013.01); *H01Q 19/10* (2013.01); *H01Q 1/427* (2013.01); *H01Q 17/00* (2013.01); *H01Q 1/3283* (2013.01); *H01Q 21/00* (2013.01); *H01Q 15/14* (2013.01); *H01Q 1/3233* (2013.01)

USPC ..... 293/117; 293/136; 296/187.09; 342/70

(58) Field of Classification Search

USPC ..... 293/117, 120, 136; 296/1.04, 187.03, 296/187.04, 187.09; 342/27, 28, 70

See application file for complete search history.

(56) References Cited

U.S. PATENT DOCUMENTS 4,400,701 A * 8/1983 Dupressoir ..... 343/725
4,884,076 A * 11/1989 Schneeberger et al. ..... 342/5

(Continued)

FOREIGN PATENT DOCUMENTS

DE 44 12 770 10/1995
DE 196 36 584 3/1998

(Continued)

OTHER PUBLICATIONS

International Search Report of the International Searching Authority for International Application PCT/DE2011/001592, mailed Nov. 28, 2012, 4 pages, European Patent Office, HV Rijswijk, Netherlands.

(Continued)

*Primary Examiner* — Glenn Dayoan
*Assistant Examiner* — Jason S Daniels
(74) *Attorney, Agent, or Firm* — W. F. Fasse

(57) ABSTRACT

An electromagnetic sensor having a detection zone in a sensor direction is at least partly enclosed by a molded part in the sensor direction and at right angles thereto. The molded part contacts and adjoins a motor vehicle part such as a bumper, whereby the molded part is between the sensor and the motor vehicle part. At least one functional element, such as a radiation absorber, a lense, a waveguide, or a reflector, may be embedded in the molded part. The sensor may be received in a pocket recess of the molded part, with an opening at the back side of the sensor.

20 Claims, 1 Drawing Sheet

(56) References Cited

U.S. PATENT DOCUMENTS

| | | | | |
|---|---|---|---|---|
| 6,489,927 | B2 * | 12/2002 | LeBlanc et al. | 343/713 |
| 6,496,138 | B1 * | 12/2002 | Honma | 342/70 |
| 2002/0067305 | A1 | 6/2002 | LeBlanc et al. | |
| 2007/0200779 | A1 | 8/2007 | Cheang et al. | |
| 2008/0278393 | A1 | 11/2008 | Gottwald et al. | |

FOREIGN PATENT DOCUMENTS

| | | |
|---|---|---|
| DE | 198 30 811 | 9/1999 |
| DE | 102005047181 | 4/2007 |
| EP | 0 575 814 | 12/1993 |
| EP | 1 471 598 | 10/2004 |
| EP | 1 750 329 | 2/2007 |
| WO | WO 2006/005546 | 1/2006 |

OTHER PUBLICATIONS

PCT International Preliminary Report on Patentability including English Translation of PCT Written Opinion of the International Searching Authority for International Application PCT/DE2011/001592, issued Feb. 12, 2013, 18 pages, International Bureau of WIPO, Geneva, Switzerland.

German Search Report for German Application No. 10 2010 034 073.1, dated Nov. 2, 2010, 4 pages, Muenchen, Germany, with English translation, 4 pages.

* cited by examiner

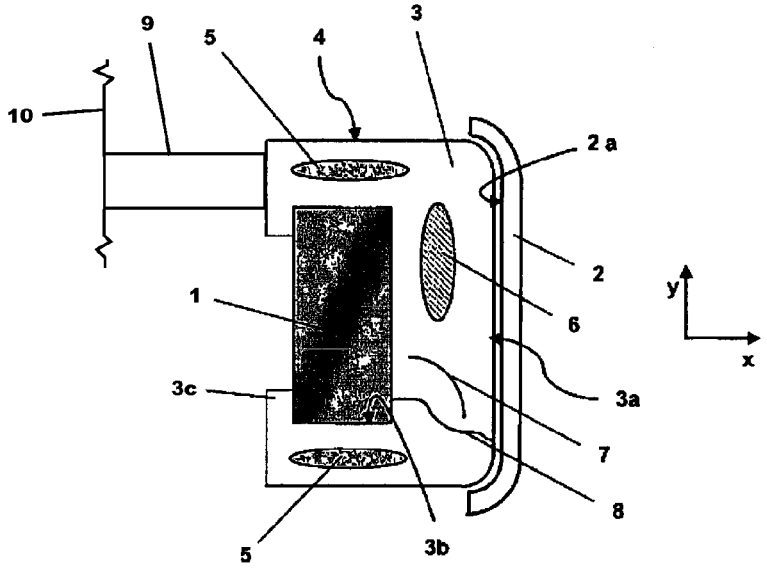
9
5
4
3
10
2 a
2
1
6
y
x
3c
3a
7
8
5
3b

DEVICE FOR FASTENING A SENSOR ASSEMBLY, ESPECIALLY A RADAR SENSOR

FIELD OF THE INVENTION

The invention relates to a device for fastening a sensor assembly on a motor vehicle, such as a radar sensor having at least one detection zone in the sensor direction.

BACKGROUND OF THE INVENTION

WO 2006/005546 A1 discloses a generic device for fastening a sensor assembly, especially a radar sensor, which device is a moulded part arranged behind a bumper of a motor vehicle by means of a collar surrounding at least part of said sensor assembly, wherein said collar consists of a material that absorbs radar radiation. In addition to its electrical shielding effect, said collar largely prevents dirt, moisture and particles from accumulating on the sensor assembly. Furthermore, said known collar can be made of a flexible material in order to reduce or absorb mechanical stress on the sensor assembly, which may occur during normal and intended use as well as in case of a less severe collision, and to prevent mechanical vibrations from being transferred. Moreover, said known collar can be placed immediately next to the bumper and may even serve as a sensor holder.

It has shown, however, that said known device for fastening a radar sensor assembly, i.e. by means of a collar, does not provide optimum protection of said sensor assembly.

SUMMARY OF THE INVENTION

An object of embodiments of this invention is therefore to improve a device for fastening a sensor assembly behind an add-on part of a motor vehicle in such a manner as to achieve improved mechanical protection of said sensor assembly.

The aforesaid object can be achieved by an embodiment of a device having the features set forth herein.

An embodiment of the invention proposes that the moulded part be a solid part, the moulded part be designed to transmit the sensor signals in the detection zone of the sensor assembly, on its side facing the assembly, the moulded part positively encloses at least part of the sensor assembly in, and at right angles to, the sensor direction, and on its side facing the add-on part, the moulded part has a surface that is shaped complementary to, and lies flat against, the surface of the motor vehicle add-on part.

The aforesaid embodiment can ensure that the sensor assembly will not be affected by dirt between the sensor assembly and the motor vehicle add-on part, which also improves signal quality. The solid structure of the moulded part also serves to achieve a mechanical protective function for the sensor assembly against vibration and shock.

In addition to said mechanical protective function of the moulded part, additional further functions can be provided in a simple manner by means of said moulded part. In this case, the moulded part serves as a carrier matrix for additional components.

For instance, according to a further development of the invention, a transmission beam generated by the sensor assembly is shaped by means of optical lens elements that are arranged in said moulded part.

Furthermore, according to another further development of the invention, the moulded part comprises absorber elements outside the detection zone, which absorb parasitic portions of a transmission beam generated by the sensor assembly.

Moreover, according to yet another embodiment of the invention, the sensor assembly has a primary radiation zone for a transmission beam it generates, and secondary radiation zones are generated due to reflection on at least one reflector element arranged in the moulded part.

Finally, according to one embodiment of the invention, a waveguide structure extending from the sensor assembly to the motor vehicle add-on part is integrated in the moulded part, which waveguide structure can be designed to be resonant and auto-calibrated over a defined length, thus allowing any blockage caused by dirt to be detected.

According to an advantageous further development of the invention, the moulded part can be elastically deformed and has mechanical dampening properties, i.e. is designed with a vibration-dampening or energy-absorbing material property. This serves to substantially improve, i.e. reduce, vibrations and shock affecting the sensor assembly, in particular mechanical stress on the sensor assembly exerted by the add-on part.

According to a further development of the invention, it is particularly advantageous if the free surface of the moulded part is hydrophobic to prevent liquids, moisture, ice or snow from accumulating on said moulded part, which would affect the performance of the sensor assembly.

The sensor assembly can easily be fastened by means of an advantageous embodiment of the invention according to which a clip or snap-in mechanism is provided to connect the moulded part to said sensor assembly.

The moulded part and the sensor assembly can be fastened on the body of the motor vehicle by means of a mechanical device.

The motor vehicle add-on part, in particular the bumper, is able to transmit the sensor signals in the detection zone of the sensor assembly.

The device according to an embodiment the invention is particularly suitable as a radar sensor assembly for motor vehicle applications.

BRIEF DESCRIPTION OF THE DRAWING

The invention will be explained in more detail below, with reference to the single drawing FIGURE.

The single drawing FIGURE shows a vertical cross-sectional view of a radar sensor that is fastened behind a bumper of a motor vehicle as an exemplary embodiment of the invention.

DETAILED DESCRIPTION OF EXAMPLE EMBODIMENTS OF THE INVENTION

In order to fasten the radar sensor 1 behind the bumper 2, an elastic and solid moulded part 3 is provided, which e.g. is made of foamed plastic and only slightly damps radar radiation. Said moulded part 3 has a pocket-shaped recess 3*b* whose inner contour is adapted to the shape of the radar sensor assembly 1. As a result, said radar sensor 1 is enclosed almost completely, i.e. in the x direction (direction of travel) as well as in the y direction. In the rearward direction, a snap-in projection 3*c* is formed on the circumferential edge of the pocket-shaped recess 3*b*, so that the radar sensor 1 can be snap-fitted in said recess 3*b*, allowing for easy mounting. In addition, another fastening device, such as a mechanical fastener device indicated schematically at 9, is provided in order to connect the radar sensor 1 to the schematically indicated body structure 10 of the motor vehicle.

The surface 3*a* of the moulded part 3 facing the add-on part is designed so as to be complementary to the opposite inner surface 2*a* of the bumper 2, so that the two surfaces 3*a* and 3*b* lie flat against each other. As a result, dirt, ice or snow are prevented from accumulating between the moulded part 3 and the bumper 2.

The close fit between the moulded part 3 and the bumper 2 prevents local vibrations of the bumper 2 from being transferred to said moulded part, thus protecting the radar sensor 1 from mechanical impact caused by the bumper 2, so that a high signal quality of the radar sensor 1 is achieved due to minimizing vibrations in the bumper 2.

In case the moulded part 3 is made of a foamed plastic, the bulk factor is adjusted such that transmission is minimally reduced by just a few decibels in the direction of propagation (x direction) of the radar beams. This requirement is for example met by foams on a polyethylene or polyurethane base.

The free surface 4 of the moulded part 3 is designed to be hydrophobic, e.g. as a liquid- and moisture-repellent coating.

Those parts of the moulded part 3 that enclose the radar sensor 1 on the side, i.e. in the y direction, contain absorbent additives in the form of graphite particles or ferromagnetic absorbent materials as absorbers 5, which e.g. are manufactured by a two-component injection moulding method. As a result, parasitic radiation that is frequently caused by surface waves and/or leakage radiation on antenna elements of the radar sensor 1 is effectively absorbed. Such a shielding in fact helps to significantly reduce the incidence of side lobes in the antenna pattern as well as the probability of false detection of objects by the radar sensor 1.

In the detection zone of the radar sensor 1, the moulded part 3 contains optical lens elements 6 for shaping the beam(s) in the near and far range, which lens elements 6 consist of a dielectric material. Another option for beam shaping in the near and far range and absorbing surface waves and leakage radiation is the incorporation of local periodic structures in the form of material geometries (Photonic Band Gaps (PBG), Electromagnetic Band Gap (EBG), Frequency Selective Surfaces (FFS)).

Furthermore, a waveguide structure 8 extending from the radar sensor 1 to the bumper 2 of the motor vehicle can be integrated in the moulded part 3. The current state of the bumper 2 (e.g. if covered with dirt, ice/snow, etc.) can then be approximately determined by analyzing the conductive properties (e.g. amplitudes and phase relations) of the conductive structure. The determined state parameters serve to detect any blockage of the sensor and to auto-calibrate sensor parameters such as transmission performance, noise behaviour, etc. In this way, degradation effects of the sensor can be detected and recalibrated during the sensor's service life.

Furthermore, reflector elements 7 incorporated in the moulded part 3 during injection moulding additionally help to shape the beam(s) and to generate additional antenna lobes. Said reflector elements 7 can also be integrated in the moulded part 3 for calibration purposes.

The device according to an embodiment of the invention for fastening the radar sensor by means of a moulded part provides reliable protection against dirt, prevents foreign matter from accumulating between the radar sensor and the bumper of the motor vehicle and serves a protective function against vibrations and shock. In addition, the performance and characteristics (directivity) of the antenna are optimized by means of functional elements that are incorporated in said moulded part, such as absorber elements, optical lens elements, waveguide structures and reflector elements.

REFERENCE NUMERALS

1 Sensor assembly, radar sensor
2 Motor vehicle add-on part, bumper
2*a* Surface of the motor vehicle add-on part 2
3 Moulded part
3*a* Surface of the moulded part 3, facing the add-on part
3*b* Pocket-shaped recess of the moulded part 3
3*c* Circumferential snap-in projection along the recess 3*b*
4 Hydrophobic surface of the moulded part 3
5 Absorber element
6 Optical lens element
7 Reflector element
8 Waveguide structure

The invention claimed is:

1. An arrangement for fastening a sensor assembly (1) on a motor vehicle, comprising a sensor assembly having at least one detection zone in a sensor direction in which the sensor assembly is effective to receive and/or emit electromagnetic waves, the sensor assembly (1) being located in an area behind a motor vehicle add-on part (2) of the motor vehicle, and a moulded part (3) arranged between the sensor assembly (1) and the motor vehicle add-on part (2), wherein the moulded part (3) is a solid part comprising a moulded material, the moulded part (3) is adapted to transmit sensor signals in the detection zone, on a side thereof facing the sensor assembly, the moulded part (3) positively encloses at least part of the sensor assembly (1) in, and at right angles to, the sensor direction, on a side thereof facing the add-on part, the moulded part (3) has a surface (3*a*) that is shaped complementary to, and lies smoothly in contact against, an adjoining surface (2*a*) of the motor vehicle add-on part (2), and the moulded part (3) serves as a carrier matrix for one or several additional components which are functional elements that are arranged and effective to influence the electromagnetic waves received and/or emitted by the sensor assembly, and that are each respectively incorporated at a respective discrete confined location in the moulded part spaced apart from the sensor assembly and spaced apart from the motor vehicle add-on part such that the one or more additional components are embedded in, surrounded on all sides thereof by, and carried by the moulded material.

2. The arrangement according to claim 1, wherein the additional components comprise at least one lens element (6) that is arranged in the moulded part (3) and that is adapted, configured and arranged to shape a transmission beam generated by the sensor assembly.

3. The arrangement according to claim 1, wherein the additional components comprise absorber elements (5) that are arranged in the moulded part outside the detection zone and that are adapted, configured and arranged to absorb parasitic portions of a transmission beam generated by the sensor assembly (1).

4. The arrangement according to claim 1, wherein the sensor assembly (1) has a primary radiation zone for a transmission beam generated by the sensor assembly, and the additional components comprise at least one reflector element (7) that is arranged in the moulded part such that at least one secondary radiation zone is generated due to reflection of said transmission beam on said at least one reflector element.

5. The arrangement according to claim 1, further comprising a waveguide structure (8) that is connected to and extends entirely between the sensor assembly (1) and the motor vehicle add-on part in the moulded part.

6. The arrangement according to claim 1, wherein the moulded part (3) has a pocket-shaped recess (3*b*) that is open at a back side opposite the motor vehicle add-on part and that receives the sensor assembly (1) therein.

7. The arrangement according to claim 1, wherein the moulded part (3) is elastically deformable and has mechanical damping properties.

8. The arrangement according to claim 1, wherein a free surface of the moulded part (3) is hydrophobic.

9. The arrangement according to claim 1, wherein the moulded part comprises a clip or snap-in configuration of the moulded part that connects the sensor assembly into the moulded part.

10. The arrangement according to claim 1, wherein the motor vehicle add-on part (2) is adapted to transmit sensor signals in the detection zone of the sensor assembly (1).

11. The arrangement according to claim 1, further comprising a mechanical fastener device, whereby the moulded part (3) and the sensor assembly (1) are adapted to be fastened on a body of the motor vehicle by the mechanical fastener device.

12. The arrangement according to claim 1, wherein the sensor assembly is a radar sensor (1).

13. The arrangement according to claim 1, wherein the motor vehicle add-on part is a motor vehicle bumper.

14. An arrangement comprising:

an exterior component of a motor vehicle;

a sensor that is effective to receive and/or emit electromagnetic waves through said exterior component;

a molded body comprising a molded material that is permeable by the electromagnetic waves, wherein said molded body has a surface that lies in contact on an adjoining surface of said exterior component, and wherein said molded body at least partly surrounds said sensor including a front surface thereof facing said exterior component; and at least one functional element that is arranged and effective to influence the electromagnetic waves received and/or emitted by said sensor, and that is located at a respective discrete confined location in said molded body spaced apart from said sensor and spaced apart from said exterior component, such that said at least one functional element is embedded in and surrounded on all sides by said molded material of said molded body.

15. The arrangement according to claim 14, wherein said at least one functional element comprises a discrete portion of said molded material that has been modified so that electromagnetic characteristics or structural characteristics thereof differ from a main portion of said molded material.

16. The arrangement according to claim 14, wherein said at least one functional element comprises a lens for the electromagnetic waves, wherein said lens is arranged in said molded body between said sensor and said exterior component, and said lens is entirely surrounded and carried by said molded material.

17. The arrangement according to claim 14, wherein said at least one functional element comprises an absorber element for the electromagnetic waves, wherein said absorber element is arranged in said molded body perpendicular to said front surface at a side of said sensor.

18. The arrangement according to claim 14, wherein said at least one functional element comprises a reflector for the electromagnetic waves, wherein said reflector is arranged in said molded body between said sensor and said exterior component, and said reflector is entirely surrounded and carried by said molded material.

19. The arrangement according to claim 14, further comprising a waveguide element for the electromagnetic waves, wherein said waveguide element is connected to and extends between said sensor and said exterior component through said molded body.

20. The arrangement according to claim 14, wherein said sensor is received in a pocket recess of said molded body, with a front side of said sensor being oriented toward said exterior component and enclosed by said molded material, and with a back side of said sensor opposite said front side being partly exposed from said molded material by an opening of said pocket recess and being partly covered by portions of said molded material that engage said sensor into said pocket recess.

* * * * *